United States Patent [19]

Kreinin

[11] 4,024,914

[45] May 24, 1977

[54] METHOD OF PROCESSING COAL CHANNELS IN UNDERGROUND COAL GASIFICATION

[76] Inventor: Efim Vulfovich Kreinin, ulitsa Chugunnye Vorota, 21, korpus 3, kv. 69, Moscow, U.S.S.R.

[22] Filed: Nov. 10, 1975

[21] Appl. No.: 630,435

[30] Foreign Application Priority Data

Dec. 27, 1974 U.S.S.R. ..... 2090251

[52] U.S. Cl. ..... 166/251; 48/DIG. 6; 166/256

[51] Int. Cl.[2] ..... E21B 43/24

[58] Field of Search ..... 48/DIG. 6; 166/251, 166/256; 299/4

[56] References Cited

UNITED STATES PATENTS 3,628,929 12/1971 Glass et al. ..... 166/256

OTHER PUBLICATIONS

Sellers, "Gasification of Coal Underground," The Gas World, Feb. 8, 1947, pp. 217–219.

*Primary Examiner*—Ernest R. Purser

*Attorney, Agent, or Firm*—Lackenbach, Lilling & Siegel

[57] ABSTRACT

A method of processing recently bored channels when putting into operation an underground gas generator (underground gasifier), consisting, on the one hand, in forced air blowing and, on the other hand, in taking away hot gases, is characterized by determining the magnitude of the hydrostatic pressure by measuring the hydrostatic column of underground waters in a vertical direction from the point at which air is forced into the well to the level of the underground waters, and adjusting the outlet section of the gas discharging wells. This permits maintaining in the boring channel a pressure at a level which is not less than that produced by the hydrostatic column to preclude an inflow of underground waters to the channel being processed. The temperature in the channel is raised at a rate from about 80° C to about 100° C per hour up to at least 500° C.

2 Claims, 3 Drawing Figures

METHOD OF PROCESSING COAL CHANNELS IN UNDERGROUND COAL GASIFICATION

The present invention relates to processes of underground coal gasification, to be applied, mainly, in preparation of underground gas generators or underground gasifer for gasification, and more particularly to a method of processing bored coal channels.

Known in the prior art is a method of processing coal channels by taking off hot gases there along, In this case, a combustion cell is created in the zone of the coal seam and an oxidizer (air) is forced through a well. A reaction of the oxidizer with hot coal produces combustion products removed from the gas discharging well through a channel bored along the coal seam. The channel may be horizontal when the gas generator is prepared by inclined-horizontal boring. When the walls of the coal channel are processed with hot gas, heat decomposition of the coal takes place, volatile substances are released and semicoke is formed.

Operation of a coal channel whose walls have already been coked is substantially facilitated (cf. Proceedings of All-Union Research Institute of Gas Industry, No. 8, pp. 91–95, "Gostechizdat" Publishers, 1962).

However, the known method does not involve special requirements as to the mode of processing when new coal channels are processed. At the same time, typical for new coal channels is a substantial inflow of underground waters, thus reducing, naturally, the temperature of the walls of the coal channels being processed. In addition, the slow rise in the temperature in the coal channel is accompanied by an intensive release of volatile substances, swelling of the walls of the coal channel and condensation of resinous fraction.

Therefore, in the case of inadequately processing of a coal channel, cause by to a substantial inflow of underground waters and negligible flow of hot gas the temperature in the coal channel did not go above 500° C for a long time, nd thus locks or clogging appeared at different portions of the coal channel.

Thus, one of the disadvantages of the known method for preparing an underground gas generator resides in frequent clogging of the coal channel being processed, thus necessitating the use of a drilling machine for cleaning the clogged coal channel. This operation does not always produce a desirable result since, when cleaning clogged coal channels, drilling is difficult because of losses due to washing and a possibility of making new bores in the coal seam past the old coal channel.

It is an object of the present invention to provide a method of processing coal channels in underground gasification of coals, which will eliminate clogging and prevent them from becoming inoperative as a result of clogging.

It is another object of the present invention to provide a method of processing coal channels in underground gasification of coals, which will rule out the necessity to carry out expensive operations of cleaning clogged coal channels by means of a drilling machine.

It is still another object of the present invention to provide a method of processing coal channels in underground gasification of coals, which will permit scheduled transition from putting an underground gas generator into operation to the process of underground gasification of the coal seam.

It is yet another object of the present invention to provide a method of processing coal channels in underground gasification of coals, which will improve the conditions of work for operators handling the underground gas generator.

These and other objects of the present invention are attained by providing a method of processing coal channels in underground gasification of coals, preferably in processing bored coal channels when putting an underground gas generator into operation, by forcing air through air blow wells into the coal seam gasification zone and by taking away hot gases from this zone through the coal channels being processed, characterized by determining the magnitude of the hydrostatic pressure by measuring the hydrostataic column of underground waters in the vertical direction from the point at which air is forced into said well to the level of said underground waters and adjusting the output section of the gas outlet wells for maintaining the pressure in the coal channel being processed at a level not less than that of said hydrostatic column, and wherein the temperature in the coal channel being processed is raised above 500° C.

According to another specific embodiment of the present invention, the method of processing a coal channel in characterized in that the temperature in the coal channel is raised at a high rate, for example, from about 80° to about 100° per hour, by controlling the flow of hot gases.

The above features of the method of processing coal channels prevent underground waters from penetrating into the coal channel being processed and, in addition, preclude intolerably intensive swelling of coal and condensation of resinous fractions capable of producing locks in the coal channels.

Specific features and advantages of the present invention will apear more completely from the following detailed description of a preferred embodiment thereof with due reference to the accompanying drawings, wherein.

Figure 2:
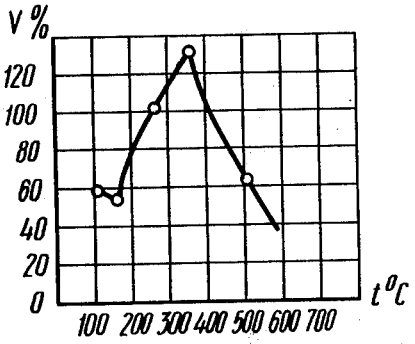
FIG. 2 illustrates data on the yield of voltaile substances.
Figure 3:
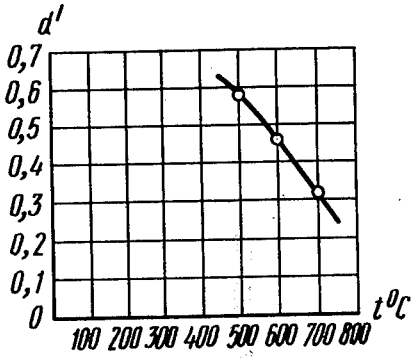
FIG. 3 is a chart showing the results of reducing the diameter of the coal channel.

FIGS. 2 and 3 show data of the laboratory tests of the South-Abinsk coal pillar with a coal channel 10 mm in diameter. The coal channel was blown with nitrogen heated to different temperatures. FIG. 2 shows the yield of coal decomposition products (V) as a function of the temperature ($t$) in the coal channel. Intensive gas release begins at 200° C to 250° C and is maximum when the coal is heated to a temperature of 350° C.

In addition, in the range of from 300° C to 400° C, coal acquires a platic state, while the decomposition gas-vapor products swell up the plastic layer due to its low gas permeability. The higher the yield of the coal decomposition products, the greater the effect of swelling.

FIG. 3 shows relative reduction of the diameter ($d$) of the coal channel $$\frac{(d'_{initial} - d''_{final})}{d'_{final}}$$

as a function of the temperature ($t$) therein. The maximum of coal swelling (reduction of the channel diameter) is observed at a temperature when the release of volatile substances becomes most active (in the range of from 300° C to 400° C). When the temperature is increased from 350° C to 700° C, the swelling rate decreases 2–2.5 times from 0.65 to 0.3.

In view of these concepts as well as peculiarities of deposition of coal seams under natural conditions, the relataively high temperature in a coal channel and high rate of its heating are necessary for processing coal channels with hot gas. However, both factors reduce the yield of volatile substances and decrease the coal channel diameter due to swelling of the coal.

During the starting period of operation of an underground gas generator, the hydrostatic column of underground waters is substantially above the horizon of forced air blow in the zone of coal gasification. Due to this, underground waters penetrate into the coal channels, reducing substantially the temperature therein when fire processing is under way.

Figure 1:
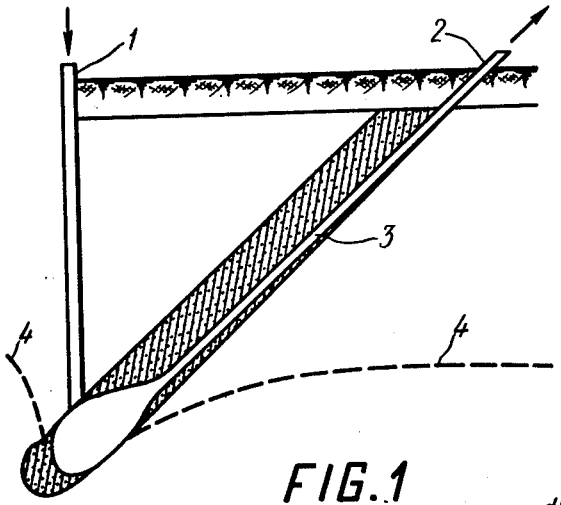
FIG. 1 is a cross-section view of an underground gas generator in an inclined coal channel.

According to the invention (FIG. 1), air is forced through a well 1 to maintain in a coal channel 3 being processed a pressure proximate to that of the hydrostatic column of underground waters above the horizon of forced air blow. As a result, the coal channel 3 is inside a funnel of underground waters, limited by lines 4. The inflow of underground waters into the coal channel 3 is minimum. When a sufficient amount of air (1,500 to 2,500 $nm^3/h$) is forced into the well 1, it is possible to provide an intensive heating of the walls of the coal channel 3. The hot gases in the coal channel should have a temperature above 500° C, whereas heating of the walls of the coal channel from 0° to 500° C are heated at a high rate. The temperature of gases in the coal channel is controlled by measuring it at the inlet to the gas discharging well 2 or by calculating the temperature at the head of the well 2 with the aid of the heat loss gradient along of its length.

Processing according to the invention is carried out as follows.

Depending on the height of the hydrostatic column of underground waters at a moment when th coal channel is processed, the gate of the gas discharging well 2 is opened to from a reduced outlet port and a respective amount of oxidizer is forced ito the air blow well 1 to maintain in the air blow well 1 a pressure higher than that of the hydrostatic column of underground waters. The initial period of the coal channel processing is very important. During this period, quick heating of the walls of the coal channel to a temperature of 500° C is required.

The method of processing coal channels according to the invention provides for intensive heating of the coal channels being processes at a high rate of heating and a high temperature of the discharged gas. These conditions preclude deposition of liquid resinous fractions in the coal channel, minimize its swelling, and at the same time speed up the coking of the walls of the coal channel. All these features as a whole raise substantially the reliability of the method of processing coal channels according to the invention.

The pressure in the coal channels being processed of inclined gas discharging wells is maintaied at a level of the hydrostatic column of underground waters (up to 10.0 atm) by opening the gate at the head of the gas discharging well to form a reduced diameter of the outlet port. An optimum consumption of air blown for processing of one gas discharging well is 1,500 to 2,500 $nm^3/h$. After 15 to 20 days of operation, the pressure in the coal channel is reduced and adjusted gradually to a normal level (0.4 to 0.8 atm).

What is claimed is:

1. In a method of processing coal channels in underground gasification of coals, particularly when processing bored coal channels during the period when an underground gas generator is put into operation, wherein a substantial amount of air is forced through air blow wells into the zone of coal seam gasification, and then hot gases from this zone are taken away through the coal channels being processed and gas discharging wells, the improvement which comprises determining the magnitude of the hydrostatic pressure by measuring the hydrostatic column of underground waters in a vertical direction from the point at which air is forced into said well to the level of said underground waters, adjusting the outlet section of gas discharging wells to maintain a pressure in the coal channels being processed at a level not less than that of said hydrostataic column of underground waters, and raising the temperature in the coal channels being processed to above 500° C, whereby swelling of the walls of the coal channels or clogging the coal channels is minimized.

2. A method as claimed in claim 1, wherein said temperature in the coal channel is raised at a high rate from about 80° C to about 100° per hour by controlling the flow of hot gases.

* * * * *